US005802630A

United States Patent [19]

Hansen et al.

[11] Patent Number: 5,802,630

[45] Date of Patent: Sep. 8, 1998

[54] INSULATED COVER FOR A HOT TUB

[75] Inventors: Borg Hansen, Calabasas; Rafael Gonzalez, Lancaster, both of Calif.

[73] Assignee: Softub, Inc., Chatsworth, Calif.

[21] Appl. No.: 840,162

[22] Filed: Apr. 14, 1997

Related U.S. Application Data

[60] Provisional application No. 60/015,418 Apr. 15, 1996.

[51] Int. Cl. [6] ..... D04H 4/08

[52] U.S. Cl. ..... 4/498; 4/503

[58] Field of Search ..... 4/498, 503, 541.1–541.5, 4/580

[56] References Cited

U.S. PATENT DOCUMENTS

| | | | |
|---|---|---|---|
| 3,287,740 | 11/1966 | Langer | 4/503 |
| 4,393,528 | 7/1983 | West | 4/498 |
| 4,422,192 | 12/1983 | Jacobs | 4/498 |
| 4,458,668 | 7/1984 | Sheldon | 4/498 |
| 4,857,374 | 8/1989 | Perry | 4/498 |
| 5,619,759 | 4/1997 | Hansen et al. | 4/498 |

*Primary Examiner*—Charles R. Eloshway
*Attorney, Agent, or Firm*—Kelly Bauersfeld Lowry & Kelley, LLP.

[57] ABSTRACT

An improved insulated cover is provided for removable mounting onto a spa or hot tub or the like to minimize thermal and evaporative losses, while additionally safeguarding against foreign objects and/or persons falling into the tub. In the preferred form, the insulated cover comprises a frame ring in combination with a structural membrane stretched across the frame ring with a peripheral margin of the membrane wrapped over the outer rim and radially constricted for retention thereon by a drawstring or the like. The constricted drawstring additionally secures an insulation plate or disk relative to the structural membrane and frame ring. The insulation plate fits with close clearance into the spa tub, when the frame ring is supported on the top of the tub wall. An outer insulation skirt may also be provided to project downwardly about the tub wall.

15 Claims, 2 Drawing Sheets

FIG. 1
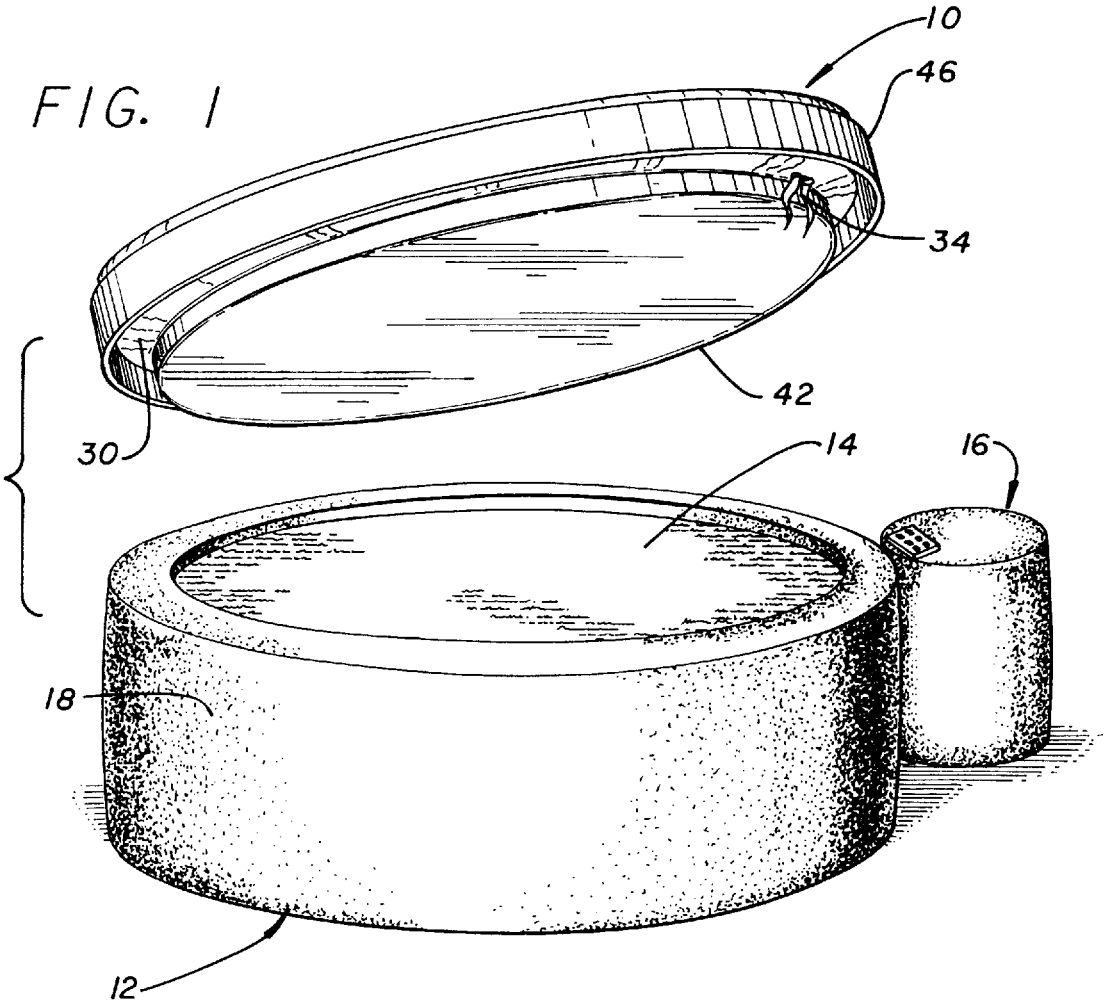
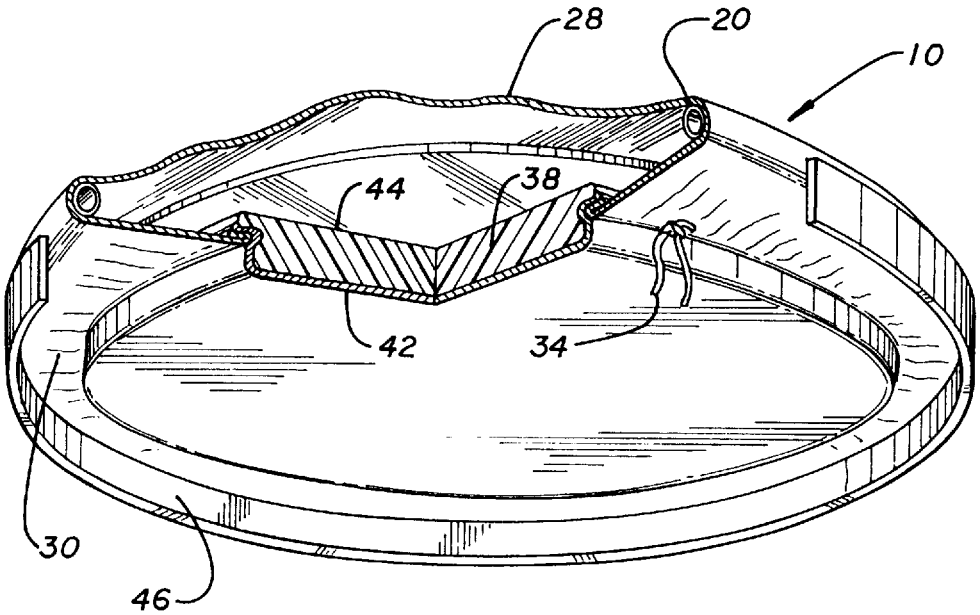
FIG. 2

FIG. 3
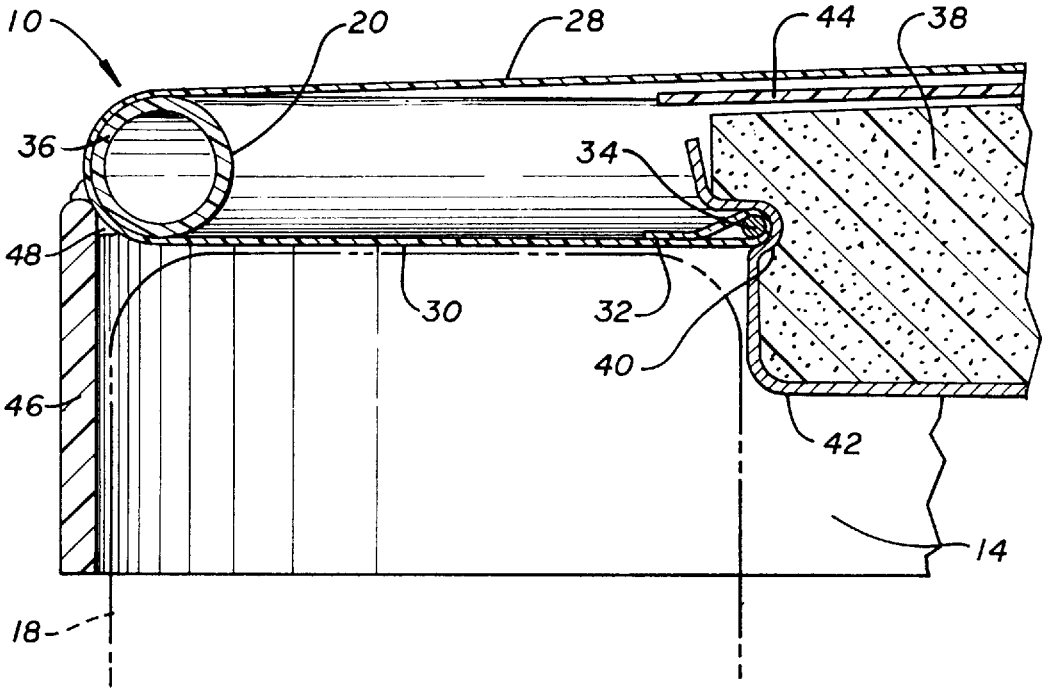
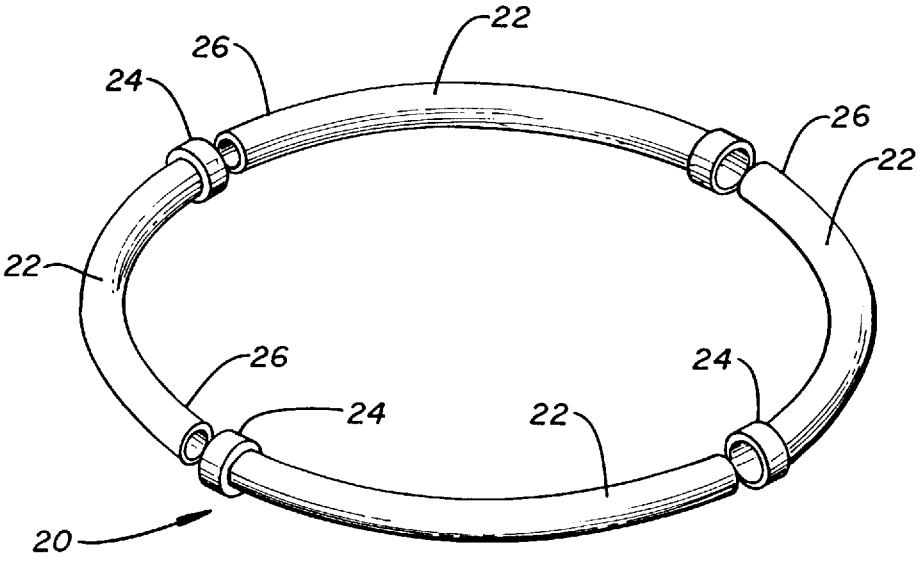
FIG. 4

INSULATED COVER FOR A HOT TUB

This application claims the benefit of U.S. Provisional application Ser. No. 60/015,418, filed Apr. 15, 1996.

BACKGROUND OF THE INVENTION

This invention relates generally to insulated covers or lids for mounting over a tank containing a heated fluid such as water, particularly such as a therapeutic spa tub or hot tub or the like. More specifically, this invention relates to a relatively simple and easily constructed insulated cover designed for minimizing water heat and evaporative losses while additionally safeguarding against foreign objects and/or persons falling into the fluid-containing tank.

Thermal covers for use with swimming pools and spa tubs and the like are generally known in the art. In one common form, such thermal covers comprise a flexible blanket of vinyl or other suitable plastic material to float on the water surface. The flexible blanket is designed to provide an insulative structure which is substantially impermeable to passage of water and air, whereby heat is substantially retained within the body of water and evaporative losses are substantially minimized. Alternative thermal covers which function in an analogous manner include an array of floating objects such as hollow plastic balls which substantially cover the water surface to retain heat and minimize evaporation. However, pool and spa covers of these types provide minimal protection against foreign objects falling into the body of water, particularly with respect to safeguarding against a child or other person falling into the water.

Other protective covers for swimming pools and spa tubs and the like have included relatively high strength blankets of canvas-based or reinforced plastic or vinyl materials, in combination with anchor devices for retaining the blanket in a configuration stretched over the water surface. Such covers beneficially provide protection against persons and foreign objects falling into the body of water, but proper attachment of the cover to the requisite anchor devices represents a time consuming and often difficult task. Moreover, the anchor devices typically require permanent attachment to structural walls or decking surfaces surrounding the pool or spa tub. Furthermore, anchored safety covers of this general type often provide minimal prevention of heat and evaporative water losses.

A protective cover for a hot tub is disclosed in U.S. Ser. No. 08/472,392, filed Jun. 7, 1995, now U.S. Pat. No. 5,619,759, having a waterproof liner mounted on a frame ring and cooperating therewith to support insulation material.

The present invention represents an improved insulative cover for a fluid-containing tank, particularly such as a spa or hot tub or the like, and particularly of the type disclosed in copending U.S. Pat. No. 5,619,759, wherein the insulative cover is adapted for quick and easy installation to protect against significant heat and evaporative losses, while additionally presenting a high strength structure to safeguard against persons and other foreign objects falling into the tank. The improved cover is structurally designed to fit quickly and easily onto the top of the upstanding wall of a spa or hot tub.

SUMMARY OF THE INVENTION

In accordance with the invention, an improved insulated cover is provided for removable mounting onto a fluid-containing tank such as a spa tub or hot tub or the like. The insulated cover has a relatively simple and lightweight construction adapted for easy assembly and installation supported on the top of the upstanding peripheral wall of a spa or hot tub, to extend over and cover a body of water or the like. In use, the insulated cover provides effective protection against thermal and evaporative losses, in addition to effective protection against persons or other foreign objects falling into the water.

In the preferred form, the insulated cover comprises a frame ring which may have a unitary one-piece construction but is preferably formed by a plurality of assembled frame segments. A structural membrane or liner of relatively high tensile strength material and which is impervious water and air passage is stretched across the frame ring with a peripheral margin of the membrane being wrapped over the outer rim and radially constricted for retention thereon by means of a drawstring or the like. The constricted drawstring is disposed radially inwardly from the frame ring and is tightly seated within a peripheral groove formed in an insulation plate or disk, thereby assembling the insulation plate relative to the structural membrane and the frame ring. In the preferred form, an underside of the insulation plate is covered by a waterproof liner, the peripheral edge of which may be secured to the insulation disk within the peripheral groove by means of the drawstring, or by use of an adhesive or other attachment means.

In use, the insulated cover has a size and shape for substantially covering the body of water. In particular, the insulated disk has a size and shape to fit into the spa or hot tub in close clearance with the side wall of the tub. The frame ring and a portion of the structural membrane adjacent the drawstring are vertically supported on the top of the tub wall. In the preferred form, an annular skirt of insulative material may be attached to the structural membrane, at the outer periphery of the frame ring, to fit down over the exterior of the tub wall.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an exploded perspective view illustrating a therapeutic spa or hot tub in association with an improved insulated cover embodying the novel features of the invention;

FIG. 2 is a bottom perspective view illustrating the insulated cover of FIG. 1, with portions broken away to depict internal construction details thereof;

FIG. 3 is an enlarged fragmented vertical sectional view showing the insulated cover installed on the spa or hot tub; and FIG. 4 is an exploded perspective view illustrating an outer frame ring, in one preferred form, for use in the insulated cover of the present invention.

DETAILED DESCRIPTION OF THE PREFERRED EMBODIMENT

As shown in the exemplary drawings, an improved insulated cover referred to generally in FIG. 1 by the reference numeral 10 is provided for use with a fluid-containing tank 12 such as a therapeutic spa tub or hot tub or the like. The insulated cover 10 is designed to prevent substantial heat loss and evaporative loss from a body of water 14 contained within the tank 12. In addition, the insulated cover 10 protects against foreign objects falling into the water 14, particularly such as safeguarding against children or other persons falling into the water.

The spa tub 12 shown in FIG. 1 has a conventional construction and operation to include a control module 16 containing an appropriate pump and heater (not shown) for circulating and heating the water 14 typically in the form of therapeutic jets. In this regard, the spa tub 12 and the related control module 16 may be constructed in accordance with commonly assigned U.S. Pat. No. 5,092,951, which is incorporated by reference herein. Importantly, the spa tub 12 defines an upwardly open enclosure, including an upstanding and preferably insulated peripheral side wall 18, for receiving and retaining the water 14.

The insulated cover 10 of the present invention is adapted for removable mounting onto the spa tub 12 when said tub is not in use. The cover 10 provides an insulative structure which is substantially impervious to passage of water and air, whereby heat losses and evaporative losses from the water 14 are substantially prevented during a period of non-use. In addition, the insulated cover 10 comprises a relatively lightweight and easily assembled structure having sufficient strength to safeguard against foreign objects falling into the water 14, particularly such as children and other persons.

FIGS. 1–4 illustrate the insulated cover 10 in one preferred form. More specifically, the cover 10 comprises a relatively lightweight outer frame ring 20 which can be constructed from tubular plastic material such as PVC tubing or the like. FIG. 4 shows a preferred frame ring construction to include an assembled plurality of telescopically interfitted tubular frame segments 22. These frame segments 22 each have an arcuate part-circular shape to include an enlarged collar 24 at one end for slide-fit reception of a narrower opposite end 26 of an adjacent frame segment 22. Construction of the frame ring 20 from such multiple segments beneficially permits the unassembled components of the cover 10 to be shipped in a compact package. The illustrative drawings show the preferred frame ring 20 to have a generally circular shape, although it will be understood that other alternative closed loop geometric configurations may be used in accordance with the configuration of the associated spa tub 12.

The outer frame ring 20, as described above, is assembled with a structural membrane 28 of a selected material which is substantially impermeable to water and air passage. The structural membrane 28 has a general geometric shape conforming to the configuration of frame ring 20, with an outer peripheral margin 30 folded back upon itself to define a closed loop formed by a seam 32 (FIG. 3), with a drawstring 34 or the like threaded through the closed loop. The structural membrane 28 is stretched across the frame ring 20, to extend across the upper side thereof and the peripheral margin 30 is wrapped downwardly about the frame ring 20 to extend radially inwardly a short distance beneath the frame ring. In this regard, the radial outermost extent of the frame ring 20 inherently defines a radially outwardly protruding rim 36 (FIG. 3) about which the peripheral margin 30 of the structural membrane 28 is wrapped. The drawstring 34 is then drawn tightly through the seam 32 and appropriately tied or secured to radially constrict the membrane outer margin 30 to a diametric size smaller than the frame ring 20. With this construction, the membrane 28 is securely attached to the frame ring 20.

In the preferred form, the outer margin 30 of the structural membrane 28 is sized to position the drawstring 34 and the associated seam loop radially inwardly from the frame ring 20 by a distance approximating the thickness of the tub wall 18. Moreover, the frame ring 20 is sized to overlie the top of the tub wall 18 generally at an outer margin or outer extent thereof (FIG. 3).

An insulation plate or disk 38 is mounted beneath the structural membrane 28 and held in place by the constricted drawstring 34. More particularly, the insulation plate or disk 38 is defined by a block of insulation material such as styrofoam or expanded urethane foam or the like with a size and shape to fit snugly within the tub wall 18 to cover the water 14. As shown in FIG. 3, the constricted drawstring 34 is seated within a peripheral groove 40 in the disk 38 to secure the disk relative to the structural membrane 28 and the frame ring 20. A waterproof liner 42 may be provided to cover the underside of the disk 38, and this liner 42 can also be held in place by the constricted drawstring as shown. Alternately, the liner 42 can be associated with or attached to a film 44 interposed between the disk 42 and the membrane 28, whereby the disk 38 is encased within the liner 42 and the film 44.

The structural membrane 28 comprises a relatively high tensile strength flexible material capable of vertically supporting anticipated loads to be applied to the insulated cover 10 during normal use. While the specific membrane material can vary, a fiber-based or fiber reinforced material which has been impregnated, or laminated with a flexible plastic such as flexible PVC or urethane is preferred.

The thus-assembled insulated cover 10 can be installed quickly and easily onto the spa tub 12, by placing the cover 10 in a position with the frame ring 20 and outer margin 30 of the structural membrane 28 rested upon an upper edge of the tub side wall 18. In this position, the insulative disk 38 is nested within the tub side wall 18 to cover the water 14 and thereby effectively minimize heat loss and evaporative losses from the body of water 14 within the tub 12. In addition, vertical loads applied to the cover 10 are effectively supported by the cover structure, particularly the structural membrane 28 which transmits such loads in tension to the frame ring 20 to support such loads in compression.

If desired, the structural and insulative capacity of the cover 10 can be enhanced by mounting an annular skirt 46 to the rim 36 defined by the frame ring 20. This skirt 46 may also be formed from a insulation material and fits down over the outside of the tub wall 18 to help locate and secure the cover in place. The skirt 46 can be attached as shown in FIG. 3 by a suitable adhesive 48, or by other suitable means.

A variety of further modifications and improvements to the insulated cover 10 of the present invention will be apparent to those skilled in the art. Accordingly, no limitation on the invention is intended by way of the foregoing description and accompanying drawings, except as set forth in the appended claims.

What is claimed is:

1. An insulated cover for removable mounting onto a spa tub having an upstanding peripheral side wall, said insulated cover comprising:

an outer frame ring formed in a closed loop configuration having a size and shape to rest on top of the side wall of the spa tub;

a structural membrane formed from a flexible material substantially impermeable to passage of air and water, said structural membrane being stretched across said frame ring with an outer margin of said structural membrane wrapped over said frame ring;

means for adjustably, radially constricting said outer margin of said structural membrane to retain said structural membrane on said frame ring; and an insulation member having a size and shape to fit generally within the side wall of the spa tub, said insulation member having a peripheral groove formed therein, said means for adjustably, radially constricting being seated within said groove for coupling said insulation member with said structural membrane.

2. The insulated cover of claim 1 wherein said means for adjustably, radially constricting comprises a drawstring.

3. The insulated cover of claim 2 wherein said outer margin of said structural membrane is seamed for receiving said drawstring.

4. The insulated cover of claim 1 further including a waterproof liner having said insulation member therein.

5. The insulated cover of claim 1 further including an outer skirt of insulative material mounted to an outer periphery of said frame ring.

6. The insulated cover of claim 1 wherein said frame ring comprises a plurality of tubing segments connected end to end to form said closed loop configuration.

7. The insulated cover of claim 1 wherein said outer margin of said structural membrane is received over and extends downwardly about the outer periphery of said frame ring, said means for adjustably, radially constricting retaining said structural membrane tightly on said frame ring.

8. The insulated cover of claim 1 wherein said insulation member comprises a relatively rigid block of insulation material.

9. An insulated cover for removable mounting onto a spa tub having an upstanding peripheral side wall, said insulated cover comprising:

an outer frame ring formed in a closed loop configuration having a size and shape to rest on top of the side wall of the spa tub;

a structural membrane formed from a flexible material substantially impermeable to passage of air and water, said structural membrane being stretched across said frame ring with an outer margin of said structural membrane wrapped over said frame ring;

means for adjustably, radially constricting said outer margin of said structural membrane to retain said structural membrane on said frame ring; and an insulation member having a size and shape to fit generally within the side wall of the spa tub, said insulation member being connected to said adjustably, radially constricted outer margin of said structural membrane.

10. The insulated cover of claim 9 wherein said means for adjustably, radially constricting comprises a drawstring.

11. The insulated cover of claim 10 wherein said outer margin of said structural membrane is seamed to define a passage for receiving said drawstring.

12. An insulated cover for removable mounting onto a spa tub having an upstanding peripheral side wall, said insulated cover comprising:

an outer frame ring formed in a closed loop configuration having a size and shape to rest on top of the side wall of the spa tub;

a structural membrane formed from a flexible material substantially impermeable to passage of air and water, said structural membrane being stretched across said frame ring with an outer margin of said structural membrane wrapped over and extending downwardly about said frame ring and extending radially inwardly from said frame ring;

means for adjustably, radially constricting said outer margin of said structural membrane to retain said structural membrane on said frame ring; and an insulation block having a size and shape to fit generally within the side wall of the spa tub, said insulation block having a peripheral groove formed therein with said means for adjustably, radially constricting seated within said groove for coupling said insulation block to said structural membrane.

13. The insulated cover of claim 12 further including a waterproof liner underlying said insulation block, said liner including a peripheral margin retained by said means for adjustably, radially constricting within said groove formed in said insulation block.

14. The insulated cover of claim 12 wherein said means for adjustably, radially constricting comprises a drawstring.

15. The insulated cover of claim 12 further including an outer insulative skirt mounted to said frame ring and having a size and shape for extending downwardly about a portion of the side wall of the spa tub.

* * * * *